US011524389B2

(12) United States Patent
Wang

(10) Patent No.: US 11,524,389 B2
(45) Date of Patent: Dec. 13, 2022

(54) POLISHING PAD AND POLISHING METHOD

(71) Applicant: IV Technologies CO., Ltd., Taichung (TW)

(72) Inventor: Yu-Piao Wang, Hsinchu County (TW)

(73) Assignee: IV Technologies CO., Ltd., Taichung (TW)

( * ) Notice: Subject to any disclaimer, the term of this patent is extended or adjusted under 35 U.S.C. 154(b) by 1112 days.

(21) Appl. No.: 16/145,221

(22) Filed: Sep. 28, 2018

(65) Prior Publication Data

US 2019/0099860 A1 Apr. 4, 2019

(30) Foreign Application Priority Data

Oct. 2, 2017 (TW) ..... 106134064

(51) Int. Cl.

| | |
|---|---|
| ***B24D 3/00*** | (2006.01) |
| ***B24D 11/04*** | (2006.01) |
| *B24D 11/00* | (2006.01) |
| *B24D 18/00* | (2006.01) |
| *C09K 3/14* | (2006.01) |

(52) U.S. Cl.

CPC ..... *B24D 11/04* (2013.01); *B24D 2203/00* (2013.01)

(58) Field of Classification Search

USPC ..... 51/293, 298

See application file for complete search history.

(56) References Cited

U.S. PATENT DOCUMENTS

| | | | | |
|---|---|---|---|---|
| 6,648,743 | B1 | 11/2003 | Burke | |
| 2016/0375550 | A1* | 12/2016 | Tong | B24D 11/001 264/48 |
| 2016/0375553 | A1* | 12/2016 | Veneziale | B24B 37/24 51/298 |
| 2016/0375555 | A1* | 12/2016 | Veneziale | B24B 37/24 51/298 |
| 2018/0147688 | A1* | 5/2018 | Broderick | B24B 37/24 |

FOREIGN PATENT DOCUMENTS

| | | |
|---|---|---|
| CN | 1550276 | 12/2004 |
| CN | 102873596 | 1/2013 |
| CN | 104781913 | 7/2015 |
| JP | 4909706 | 4/2012 |
| TW | 201429621 | 8/2014 |

OTHER PUBLICATIONS

"Office Action of China Counterpart Application", dated Aug. 5, 2019, p. 1-p. 10.

* cited by examiner

*Primary Examiner* — James E McDonough
(74) *Attorney, Agent, or Firm* — JCIPRNET

(57) ABSTRACT

A polishing pad is provided. The polishing pad, suitable for polishing an object, includes a polishing layer and at least one groove. The polishing layer has a central region and a peripheral region surrounding the central region. The at least one groove is disposed in the polishing layer, wherein the at least one groove has two ends both located in the peripheral region, wherein the two ends include an open end and a closed end.

13 Claims, 7 Drawing Sheets

POLISHING PAD AND POLISHING METHOD

CROSS-REFERENCE TO RELATED APPLICATION

This application claims the priority benefit of Taiwan application Ser. No. 106134064, filed on Oct. 2, 2017. The entirety of the above-mentioned patent application is hereby incorporated by reference herein and made a part of this specification.

BACKGROUND OF THE INVENTION

Field of the Invention

The invention relates to a polishing pad and a polishing method, and more particularly, to a polishing pad that may retain polishing fluid longer or effectively discharge byproduct during the polishing process and a polishing method using the polishing pad.

Description of Related Art

In the industrial device manufacturing process, the polishing process is often used to planarize the surface of an object. The polishing process is performed by providing polishing fluid on a polishing pad, pressing the object on the polishing pad and applying a relative motion between the object and the polishing pad. In the polishing process, the polishing fluid remaining on the polishing pad may facilitate to remove the material of the object surface for achieving the planarization. Moreover, byproduct may be generated during the polishing process, such as debris generated by the polishing or reacted product resulting from the reaction between the polishing fluid and the object surface.

In industrial applications, the requirement of some polishing processes includes a polishing pad that may retain the polishing fluid, and the requirement of some other polishing processes includes a polishing pad that may effectively discharge byproduct generated by the polishing. Therefore, different types of polishing pads still need to be provided in response to the industrial requirements of different polishing processes.

SUMMARY OF THE INVENTION

Accordingly, the invention provides a polishing pad and a polishing method that may retain the polishing fluid or effectively discharge byproduct during the polishing process.

A polishing pad of some embodiments of the invention is suitable for polishing an object and includes a polishing layer and at least one groove. The polishing layer has a central region and a peripheral region surrounding the central region. The at least one groove is disposed in the polishing layer, wherein the at least one groove has two ends both located in the peripheral region, wherein the two ends include an open end and a closed end.

A polishing pad of some embodiments of the invention is suitable for polishing an object and includes a polishing layer, at least one groove, and a virtual extending straight line. The polishing layer has a central region and a peripheral region surrounding the central region. The at least one groove is disposed in the polishing layer, wherein the at least one groove has two ends both located in the peripheral region. The virtual extending straight line passes through the center of the polishing pad and is perpendicular to the tangential direction of the at least one groove, wherein the at least one groove is not symmetric with respect to the virtual extending straight line.

A polishing method of some embodiments of the invention includes the following steps. A polishing pad is provided, wherein the polishing pad is the polishing pad described above. A pressure is applied to the object to press the object on the polishing pad. A relative motion is applied between the object and the polishing pad to perform a polishing procedure.

Based on the above, the polishing pad of the invention includes at least one groove having two ends both located in the peripheral region and including an open end and a closed end, such that when a polishing procedure is performed on an object using the polishing pad, the polishing fluid may be retained or the byproduct generated by the polishing may be effectively discharged to meet the requirements of different polishing processes in the industry.

In order to make the aforementioned features and advantages of the disclosure more comprehensible, embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
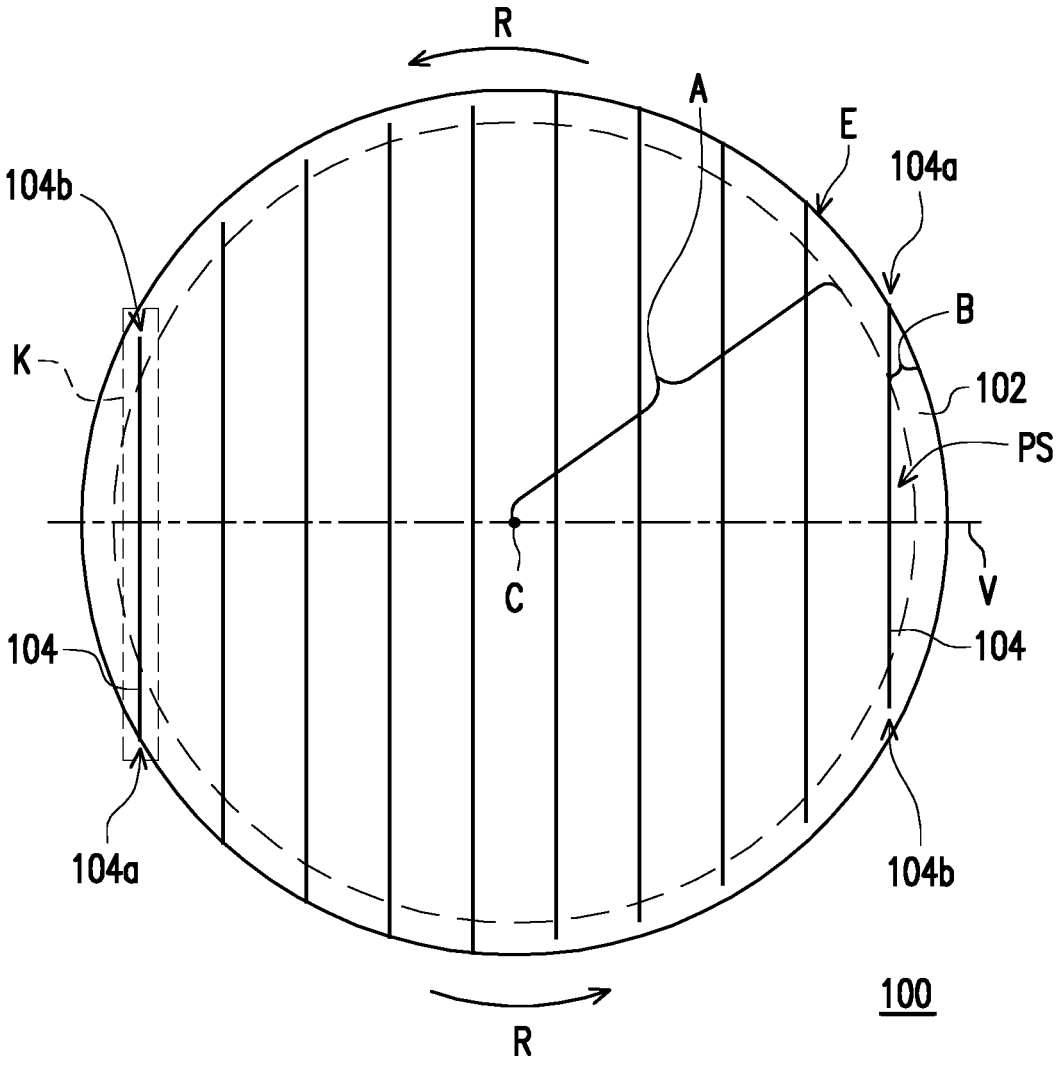
FIG. 1 is a top view of a polishing pad according to an embodiment of the invention.
Figure 2:
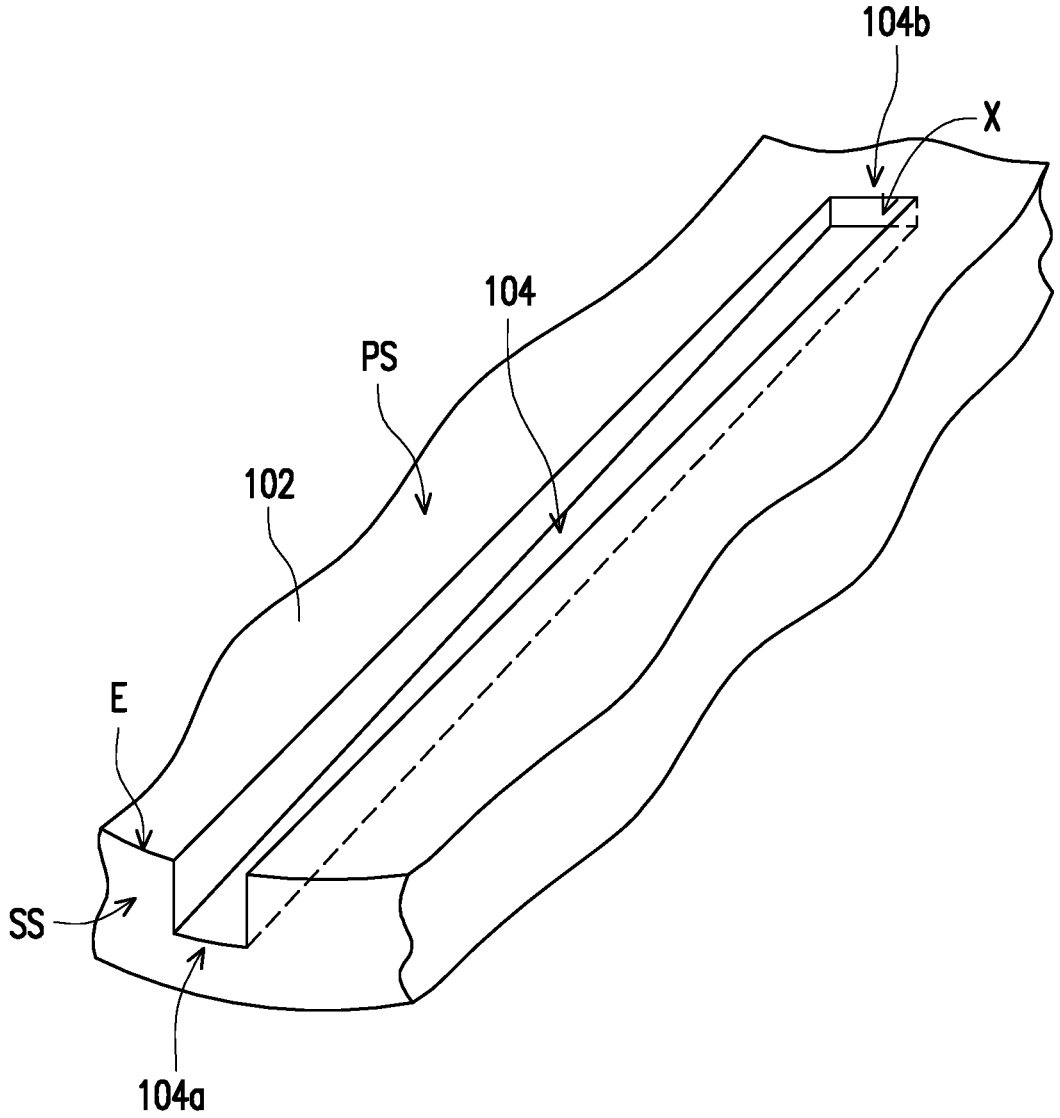
FIG. 2 is a perspective view of region K in FIG. 1.

FIG. 1 is a top view of a polishing pad according to an embodiment of the invention. FIG. 2 is a perspective view of region K in FIG. 1.

Referring to both FIG. 1 and FIG. 2, a polishing pad 100 includes a polishing layer 102 and at least one groove 104 disposed in the polishing layer 102. The at least one groove 104, for instance, may comprise a plurality of grooves 104 (shown in FIG. 1) disposed in the polishing surface PS of the polishing layer 102. Moreover, the polishing pad 100 has a rotational axis C. When a polishing procedure is performed on an object using the polishing pad 100, the polishing pad 100 is fixed on the platen (not shown) of the polishing equipment, and the polishing pad 100 is rotated in a rotational direction R along a rotational axis C through platen rotation. That is, the polishing pad 100 is rotated in a counterclockwise direction. The rotational axis C is, for instance, located at the center of the polishing pad 100. In the case of the circular polishing pad 100 shown in FIG. 1, the rotational axis C is, for instance, located at the center of the circular polishing pad 100.

The polishing layer 102 has a central region A and a peripheral region B, wherein the peripheral region B surrounds the central region A. In an embodiment, when a polishing procedure is performed on an object using the polishing pad 100, the polishing trajectory of the object on the polishing layer 102 may be located in the central region A. Moreover, the grooves 104 each may have two ends 104*a* and 104*b* both located in the peripheral region B, and the groove 104 may be extended through the central region A. In other words, in the present embodiment, each of the grooves 104 may be extended from the peripheral region B to the central region A and then extended to the peripheral region B after passing through the central region A. In other words, the groove 104 may be extended through the polishing trajectory of the object, and therefore the polishing fluid accommodated in the groove 104 may sufficiently contact with the polished object. Moreover, after the object is polished, the polishing pad 100 may prevent the issue of de-chunk fail of the object (i.e., failure to lift the object away from the polishing surface PS of the polishing pad 100). The width of the peripheral region B (i.e., the width from an edge E in the radius direction) is, for instance, between 5 mm and 80 mm, but the invention is not limited thereto.

Moreover, the polishing layer 102 has a polishing surface PS and a side surface SS connected to the polishing surface PS. When a polishing procedure is performed on an object using the polishing pad 100, the object is in contact with the polishing surface PS of the polishing layer 102. In other words, the object is in contact with the polishing surface PS located in the central region A of the polishing layer 102. In the present embodiment, the polishing pad 102 is, for instance, formed of a polymer material such as polyester, polyether, polyurethane, polycarbonate, polyacrylate, polybutadiene, or other polymer materials synthesized by a suitable thermosetting resin or thermoplastic resin, but the invention is not limited thereto.

As shown in FIG. 1 and FIG. 2, the groove 104 has two ends 104*a* and 104*b* both located in the peripheral region B, wherein the end 104*a* is the open end and the end 104*b* is the closed end. The open end 104*a* is connected to the side surface SS of the polishing layer 102 and does not have any end surface, and the closed end 104*b* is not connected to the side surface SS of the polishing layer 102 and has one end surface X. In other words, the open end 104*a* is located at the edge E of the polishing layer 102, and the closed end 104*b* is located within the polishing layer 102 having a spacing between the closed end 104*b* and the edge E, and the spacing is, for instance, between 1 mm and 70 mm, but the invention is not limited thereto. Moreover, in the embodiment shown in FIG. 2, the end surface X of the closed end 104*b* is a vertical surface, and the end surface X is perpendicular to the polishing surface PS and connected to the bottom surface of the groove 104 with a transition (i.e., a turn) therebetween, but the invention is not limited thereto. In another embodiment, the end surface X of the closed end 104*b* may also be an inclined surface and connected to the bottom surface of the groove 104 with a transition therebetween, or the end surface X of the closed end 104*b* may also be an inclined surface without a transition between the inclined surface and the bottom surface of the groove 104. In other words, the depth of the groove 104 is gradually decreased form the open end 104*a* toward the closed end 104*b* and a spacing exists between the closed end 104*b* and the edge E.

As described above, in the present embodiment, the rotational direction R of the polishing pad 100 is exemplified by a counterclockwise direction, and therefore in correspondence to the relative motion direction of the polishing pad 100, the open end 104*a* is the front end and the closed end 104*b* is the rear end. Specifically, for the groove 104 located at the right side of the rotational axis C, the open end 104*a* (i.e., front end) is located at the upper right of the rotational axis C, and the closed end 104*b* (i.e., rear end) is located at the lower right of the rotational axis C. For the groove 104 located at the left side of the rotational axis C, the open end 104*a* (i.e., front end) is located at the lower left of the rotational axis C, and the closed end 104*b* (i.e., rear end) is located at the upper left of the rotational axis C. In a conventional polishing pad having a similar groove pattern distribution, the two ends of each groove are both open ends. Driven by the inertial force, the polishing fluid readily flows out of the conventional polishing pad from the rear end. In comparison, in the present embodiment, in correspondence to the relative motion direction of the polishing pad 100, since the rear end of the groove 104 is the closed end 104*b*, the polishing fluid may be blocked from flowing out of the polishing pad 100 from the rear end. As a result, in comparison to the conventional polishing pad, the polishing pad 100 of the invention may retain the polishing fluid, and therefore for some actual polishing processes, the polishing pad 100 of the invention may achieve a higher polishing rate to increase productivity, or the used amount of the polishing fluid may be reduced to save cost.

As shown in FIG. 2, in the present embodiment, the groove 104 has an inclined depth, wherein the depth of the groove 104 is gradually increased from the closed end 104*b* to the open end 104*a*. However, the invention is not limited thereto. In other embodiments, the groove 104 may also not have an inclined depth and have the same depth. It should be mentioned that, in the present embodiment, the depth inclination (i.e., the inclination of the depth) of the groove 104 may be selected based on the rotation rate of the polishing pad 100. In a general polishing process, the rotation rate of the polishing pad 100 during the polishing step is generally greater than the rotation rate of the polishing pad 100 during other steps, and therefore a greater inertial force is generated. Thereby, the driving force of the polishing fluid flowing from the front end toward the rear end is greater such that the probability of the polishing fluid flowing out of the open front end is reduced, thereby the polishing fluid can be retained on the polishing pad 100. During the cleaning step after the polishing step, such as cleaning the surface of the polishing pad 100 with water, the rotation rate of the polishing pad 100 is less than the rotation rate of the polishing pad 100 during the polishing step, or the rotation of the polishing pad 100 during the cleaning step is stopped, and therefore a less inertial force is generated, or inertial force is absent. At this point, in comparison to the case in which each groove has the same depth, the cleaning efficiency may be enhanced via the groove 104 having an inclined depth to reduce the used amount of water for cleaning. Therefore, in the present embodiment, in addition to retaining the polishing fluid on the polishing pad 100, the cleaning efficiency may also be enhanced.

Moreover, as shown in FIG. 1, the polishing pad 100 includes a virtual extending straight line V, the virtual extending straight line V passes through the center of the polishing pad 100 and is perpendicular to the tangential direction of the groove 104, and the groove 104 is not symmetric with respect to the virtual extending straight line V. In the present embodiment, since the groove 104 is straight line, and the tangential direction of the groove 104 is the direction of the groove 104 itself (i.e., vertical direction), the extending direction of the virtual extending straight line V is the horizontal direction laterally passing through the diameter of the polishing pad 100. Specifically, the configurations of the two sides of the groove 104 respective to the virtual extending straight line V are asymmetric, in other words, the configurations of the two sides of the groove 104 respective to the virtual extending straight line V are not mirror images of each other, and the reason is that one end of the groove 104 is the open end 104*a* and the other end of the groove 104 is the closed end 104*b*. Moreover, as shown in FIG. 1 and FIG. 2, the depths of the two sides of the groove 104 respective to the virtual extending straight line V may optionally be asymmetric, in other words, the depths of the two sides of the groove 104 respective to the virtual extending straight line V may optionally be not mirror images of each other, and the reason is that the depth of the groove 104 may be gradually increased from the closed end 104*b* to the open end 104*a*.

In the embodiment of FIG. 1, the grooves 104 are linear grooves, but the invention is not limited thereto. In other embodiments, the grooves 104 may also be arc grooves. Moreover, in the embodiment of FIG. 1, although the distribution profile of the grooves 104 is a parallel lines shape, the invention is not limited thereto. In other embodiments, the distribution profile of the grooves each having two ends of the polishing pad may also be a non-parallel lines shape, an XY grid lines shape, a cross-hatched lines shape, a concentric arcs shape, an eccentric arcs shape, an irregular arcs shape, a combination thereof, or a combination of a parallel lines shape and the various distribution profiles above, wherein the open end of the groove is the front end and the closed end of the groove is the rear end. In the following, detailed description is provided for other configurations with reference to FIG. 3 and FIG. 4.

Figure 3:
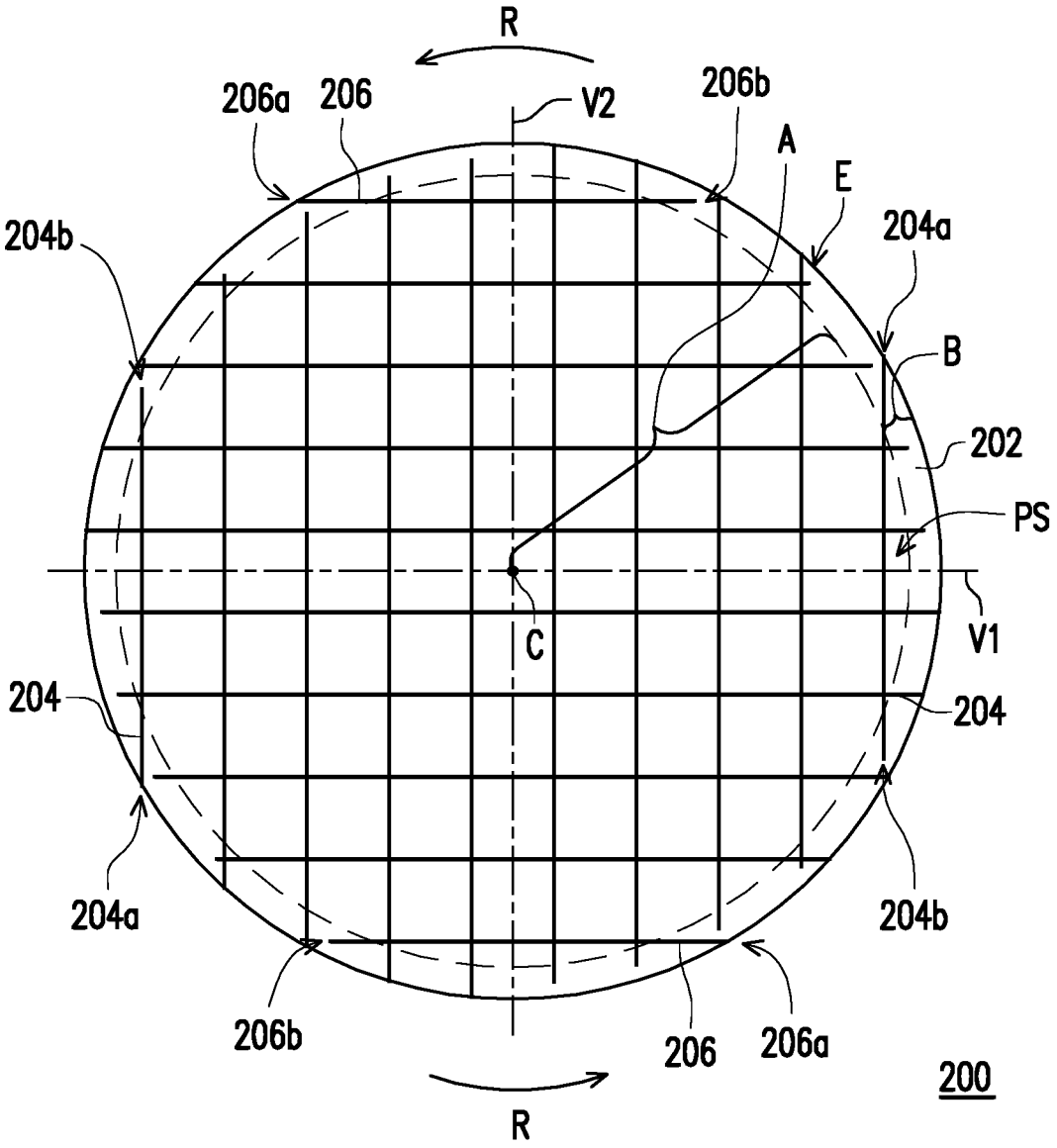
FIG. 3 is a top view of a polishing pad according to another embodiment of the invention.

FIG. 3 is a top view of a polishing pad according to another embodiment of the invention. Referring to both FIG. 3 and FIG. 1, a polishing pad 200 of FIG. 3 is similar to the polishing pad 100 of FIG. 1, and therefore the same or similar elements are represented by the same or similar reference numerals, and relevant descriptions are not repeated. It should be mentioned that, a polishing layer 202, grooves 204, and ends 204*a* and 204*b* may be the same as or similar to their counterparts in the embodiment of FIG. 1 (i.e., the polishing layer 102, the grooves 104, and the ends 104*a* and 104*b*), and therefore relevant description is not repeated herein. Moreover, the partial perspective schematic of the polishing pad 200 is shown in FIG. 2. In the following, the differences between the polishing pad 200 and the polishing pad 100 are described.

Referring to FIG. 3, the polishing pad 200 includes at least one groove 206 disposed in the polishing layer 202, and the at least one groove 206, for instance, may comprise a plurality of grooves 206 (shown in FIG. 3) disposed in the polishing surface PS of the polishing layer 202. Specifically, the grooves 206 each may have two ends 206*a* and 206*b* both located in the peripheral region B, and the groove 206 may be extended through the central region A. In other words, in the present embodiment, each of the grooves 206 may be extended from the peripheral region B to the central region A and then extended to the peripheral region B after passing through the central region. A. In other words, the groove 206 may be extended through the polishing trajectory of the object, and therefore the polishing fluid accommodated in the groove 206 may sufficiently contact with the polished object. Moreover, after the object is polished, the polishing pad 200 may prevent the issue of de-chunk fail of the object (i.e., failure to lift the object away from the polishing surface PS of the polishing pad 200). The width of the peripheral region B (i.e., the width from the edge E in the radius direction) is, for instance, between 5 mm and 80 mm, but the invention is not limited thereto.

It may be known from the embodiments of FIG. 1 and FIG. 2 that, in the present embodiment, the groove 206 has two ends 206*a* and 206*b* both located in the peripheral region B, wherein the end 206*a* is the open end and the end 206*b* is the closed end. The open end 206*a* is connected to the side surface SS of the polishing layer 202 and does not have any end surface, and the closed end 206*b* is not connected to the side surface SS of the polishing layer 202 and has one end surface X. In other words, the open end 206*a* is located at the edge E of the polishing layer 202, and the closed end 206*b* is located within the polishing layer 202 having a spacing between the closed end 206*b* and the edge E, and the spacing is, for instance, between 1 mm and 70 mm, but the invention is not limited thereto. Moreover, it may be known from the embodiments of FIG. 1 and FIG. 2 that, in an embodiment, the end surface X of the closed end 206*b* may be a vertical surface, and the end surface X is perpendicular to the polishing surface PS and connected to the bottom surface of the groove 206 with a transition (i.e., a turn) therebetween. In another embodiment, the end surface X of the closed end 206*b* may be an inclined surface and connected to the bottom surface of the groove 206 with a transition therebetween. In yet another embodiment, the end surface X of the closed end 206*b* may also be an inclined surface without a transition between the inclined surface and the bottom surface of the groove 206. In other words, the depth of the groove 206 is gradually decreased form the open end 206*a* toward the closed end 206*b* and a spacing exists between the closed end 206*b* and the edge E.

In the present embodiment, a plurality of grooves 204 parallel and not connected to one another are intersected with a plurality of grooves 206 parallel and not connected to one another to form grid grooves. As a result, the transmission efficiency of the polishing fluid may be improved. In other words, in the present embodiment, via two sets of grooves (i.e., the plurality of grooves 204 and the plurality of grooves 206) intersected with each other, the transmission efficiency of the polishing fluid on the polishing pad 200 may be enhanced.

In the present embodiment, the rotational direction R of the polishing pad 200 is exemplified by a counterclockwise direction, and therefore in correspondence to the relative motion direction of the polishing pad 200, the open end 206*a* is the front end and the closed end 206*b* is the rear end. In other words, in the present embodiment, in correspondence to the relative motion direction of the polishing pad 200, the open end 204*a* and the open end 206*a* are front ends and the closed end 204*b* and the closed end 206*b* are rear ends. Specifically, for the groove 204 located at the right side of the rotational axis C, the open end 204*a* (i.e., front end) is located at the upper right of the rotational axis C, and the closed end 204*b* (i.e., rear end) is located at the lower right of the rotational axis C. For the groove 204 located at the left side of the rotational axis C, the open end 204*a* (i.e., front end) is located at the lower left of the rotational axis C, and the closed end 204*b* (i.e., rear end) is located at the upper left of the rotational axis C. Moreover, for the groove 206 located above the rotational axis C, the open end 206*a* (i.e., front end) is located at the upper left of the rotational axis C, and the closed end 206*b* (i.e., rear end) is located at the upper right of the rotational axis C. For the groove 206 located below the rotational axis C, the open end 206*a* (i.e., front end) is located at the lower right of the rotational axis C, and the closed end 206*b* (i.e., rear end) is located at the lower left of the rotational axis C. In a conventional polishing pad having a similar groove pattern distribution, the two ends of each groove are both open ends. Driven by the inertial force, the polishing fluid readily flows out of the conventional polishing pad from the rear end. In comparison, in an embodiment of the invention, in correspondence to the relative motion direction of the polishing pad 200, since the rear end of the groove 204 is the closed end 204*b* and the rear end of the groove 206 is the closed end 206*b*, the polishing fluid may be blocked from flowing out of the polishing pad 200 from the rear end. In comparison to the conventional polishing pad, the polishing pad 200 of the invention may retain the polishing fluid, and therefore for some actual polishing processes, the polishing pad 200 of the invention may achieve a higher polishing rate to increase productivity, or the used amount of the polishing fluid may be reduced to save cost.

It may be known from the embodiments of FIG. 1 and FIG. 2 that, in the present embodiment, similar to the groove 204, the groove 206 may also have an inclined depth, wherein the depth of the groove 206 is gradually increased from the closed end 206*b* to the open end 206*a*. In other words, the groove 206 may have the structure shown in FIG. 2. However, the invention is not limited thereto. In other embodiments, the groove 206 may also not have an inclined depth and have the same depth. It should be mentioned that, in the present embodiment, the depth inclination (i.e., the inclination of the depth) of the groove 206 may be selected based on the rotation rate of the polishing pad 200. In a general polishing process, the rotation rate of the polishing pad 200 during the polishing step is generally greater than the rotation rate of the polishing pad 200 during other steps, and therefore a greater inertial force is generated. Thereby, the driving force of the polishing fluid flowing from the front end toward the rear end is greater such that the probability of the polishing fluid flowing out of the open front end is reduced, and the feature of retaining the polishing fluid on the polishing pad 200 may be kept. During the cleaning step after the polishing step, such as cleaning the surface of the polishing pad 200 with water, the rotation rate of the polishing pad 200 is less than the rotation rate of the polishing pad 200 during the polishing step, or the rotation of the polishing pad 200 during the cleaning step is stopped, and therefore a less inertial force is generated, or inertial force is absent. At this point, in comparison to the case in which each groove has the same depth, the polishing pad 200 may enhance the cleaning efficiency via the groove 204 and the groove 206 respectively having an inclined depth to reduce the used amount of water for cleaning. Therefore, in the present embodiment, in addition to retaining the polishing fluid on the polishing pad 200, the cleaning efficiency may also be enhanced.

Moreover, as shown in FIG. 3, the polishing pad 200 includes virtual extending straight lines V1 and V2. The virtual extending straight line V1 passes through the center of the polishing pad 200 and is perpendicular to the tangential direction of the groove 204, wherein the groove 204 is not symmetric with respect to the virtual extending straight line V1. The virtual extending straight line V2 passes through the center of the polishing pad 200 and is perpendicular to the tangential direction of the groove 206, and the groove 206 is not symmetric with respect to the virtual extending straight line V2. In the present embodiment, since the groove 204 is straight line and the tangential direction of the groove 204 is the direction of the groove 204 itself (i.e., vertical direction), the extending direction of the virtual extending straight line V1 is the horizontal direction laterally passing through the diameter of the polishing pad 200. Moreover, since the groove 206 is straight line and the tangential direction of the groove 206 is the direction of the grooves 206 itself (i.e., horizontal direction), the extending direction of the virtual extending straight line V2 is the vertical direction longitudinally passing through the diameter of the polishing pad 200. Specifically, the configurations of the two sides of the groove 204 respective to the virtual extending straight line V1 are asymmetric, and the configurations of the two sides of the groove 206 respective to the virtual extending straight line V2 are asymmetric. In other words, the configurations of the two sides of the groove 204 respective to the virtual extending straight line V1 are not mirror images of each other, and the reason is that one end of the groove 204 is the open end 204*a*, and the other end of the groove 204 is the closed end 204*b*; and the configurations of the two sides of the groove 206 respective to the virtual extending straight line V2 are not mirror images of each other, and the reason is that one end of the groove 206 is the open end 206*a*, and the other end of the groove 206 is the closed end 206*b*. Moreover, it may be known from the embodiments of FIG. 1 and FIG. 2 that, the depths of the two sides of the groove 204 respective to the virtual extending straight line V1 may optionally be asymmetric, and the depths of the two sides of the groove 206 respective to the virtual extending straight line V2 may optionally be asymmetric. In other words, the depths of the two sides of the groove 204 respective to the virtual extending straight line V1 may optionally be not mirror images of each other, and the reason is that the depth of the groove 204 may be gradually increased from the closed end 204*b* to the open end 204*a*; and the depths of the two sides of the groove 206 respective to the virtual extending straight line V2 may optionally be not mirror images of each other, and the reason is that the depth of the groove 206 may be gradually increased from the closed end 206*b* to the open end 206*a*.

Figure 4:
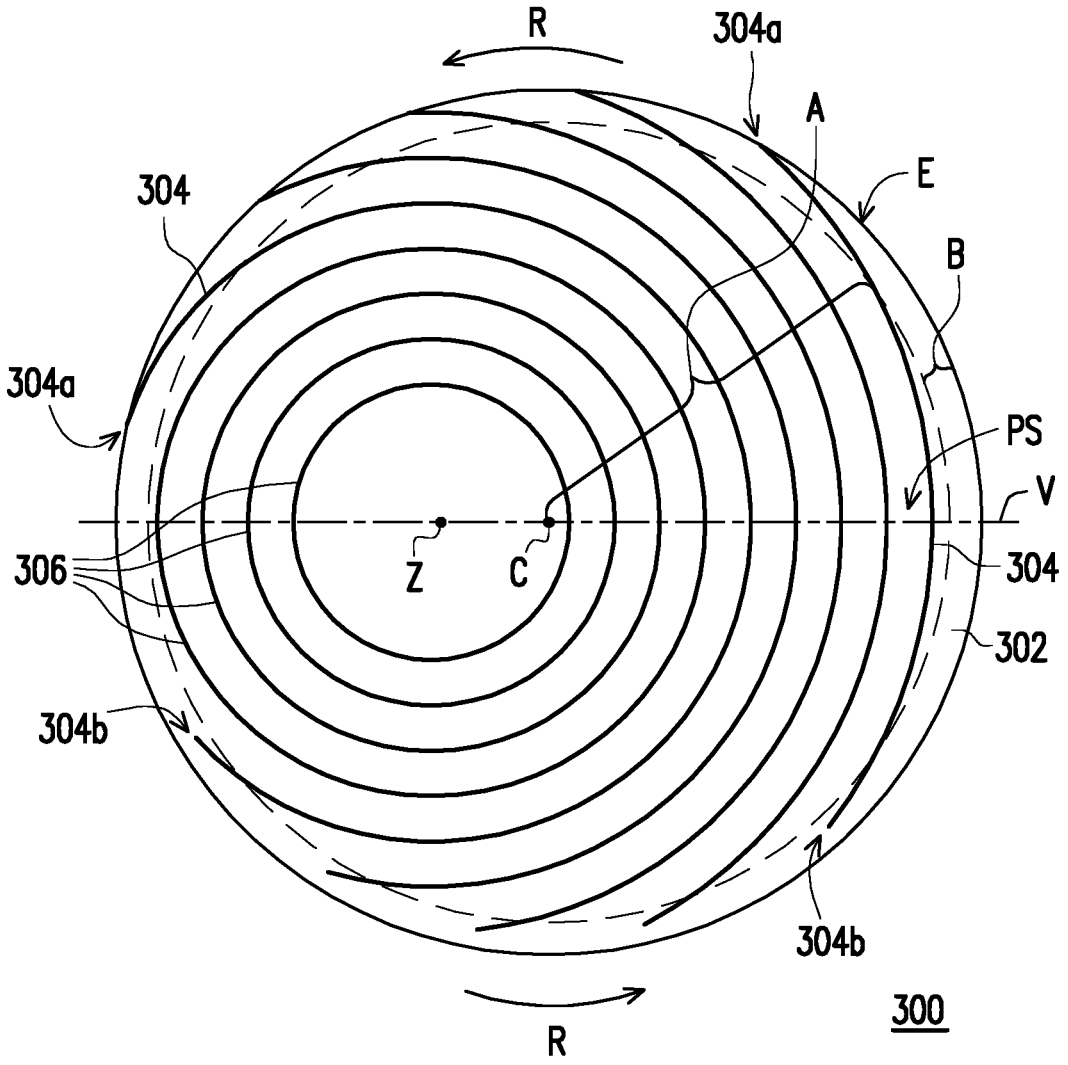
FIG. 4 is a top view of a polishing pad according to another embodiment of the invention.

FIG. 4 is a top view of a polishing pad according to another embodiment of the invention. Referring to both FIG. 4 and FIG. 1, a polishing pad 300 of FIG. 4 is similar to the polishing pad 100 of FIG. 1, and therefore the same or similar elements are represented by the same or similar reference numerals, and relevant descriptions are not repeated. It should be mentioned that, the polishing layer 302 may be the same as or similar to their counterparts in the embodiment of FIG. 1 (i.e., the polishing layer 102), and therefore relevant description is not repeated herein. Moreover, the partial perspective schematic of the polishing pad 300 is shown in FIG. 2. In the following, the differences between the polishing pad 300 and the polishing pad 100 are described.

Referring to FIG. 4, the polishing pad 300 includes at least one groove 304 disposed in the polishing layer 302, and the at least one groove 304, for instance, may comprise a plurality of grooves 304 (shown in FIG. 4) disposed in the polishing surface PS of the polishing layer 302. Specifically, the grooves 304 each may have two ends 304*a* and 304*b* both located in the peripheral region B, and the groove 304 may be extended through the central region A. In other words, in the present embodiment, each of the grooves 304 may be extended from the peripheral region B to the central region A and then extended to the peripheral region B after passing through the central region A. In other words, the groove 304 may be extended through the polishing trajectory of the object, and therefore the polishing fluid accommodated in the groove 304 may sufficiently contact with the polished object. Moreover, after the object is polished, the polishing pad 300 may prevent the issue of de-chunk fail of the object (i.e., failure to lift the object away from the polishing surface PS of the polishing pad 300). The width of the peripheral region B (i.e., the width from the edge E in the radius direction) is, for instance, between 5 mm and 80 mm, but the invention is not limited thereto.

It may be known from the embodiments of FIG. 1 and FIG. 2 that, in the present embodiment, the groove 304 has two ends 304*a* and 304*b* both located in the peripheral region B, wherein the end 304*a* is the open end and the end 304*b* is the closed end. The open end 304*a* is connected to the side surface SS of the polishing layer 302 and does not have any end surface, and the closed end 304*b* is not connected to the side surface SS of the polishing layer 302 and has one end surface X. In other words, the open end 304*a* is located at the edge E of the polishing layer 302, and the closed end 304*b* is located within the polishing layer 302 having a spacing between the closed end 304*b* and the edge E, and the spacing is, for instance, between 1 mm and 70 mm, but the invention is not limited thereto. Moreover, it may be known from the embodiments of FIG. 1 and FIG. 2 that, in an embodiment, the end surface X of the closed end 304*b* may be a vertical surface, and the end surface X is perpendicular to the polishing surface PS and connected to the bottom surface of the groove 304 with a transition (i.e., a turn) therebetween. In another embodiment, the end surface X of the closed end 304*b* may be an inclined surface and connected to the bottom surface of the groove 304 with a transition. In yet another embodiment, the end surface X of the closed end 304*b* may also be an inclined surface without a transition between the inclined surface and the bottom surface of the groove 304. In other words, the depth of the groove 304 is gradually decreased form the open end 304*a* toward the closed end 304*b* and a spacing exists between the closed end 304*b* and the edge E.

In the present embodiment, each of the grooves 304 is a circular arc groove, and a center Z thereof is not overlapped with the rotational axis C of the polishing pad 300. More specifically, in the present embodiment, the plurality of grooves 304 are concentric circular arc grooves having different radii.

In the present embodiment, the rotational direction R of the polishing pad 300 is exemplified by a counterclockwise direction, and therefore in correspondence to the relative motion direction of the polishing pad 300, the open end 304*a* is the front end and the closed end 304*b* is the rear end. Specifically, since the groove 304 is located at the right side of the rotational axis C, the open end 304*a* (i.e., front end) is located above the axis rotation C, and the closed end 304*b* (i.e., rear end) is located below the rotational axis C. In a conventional polishing pad having a similar groove pattern distribution, the two ends of each groove are both open ends. Driven by the inertial force, the polishing fluid readily flows out of the conventional polishing pad from the rear end. In comparison, in an embodiment of the invention, in correspondence to the relative motion direction of the polishing pad 300, since the rear end of the groove 304 is the closed end 304*b*, the polishing fluid may be blocked from flowing out of the polishing pad 300 from the rear end. In comparison to the conventional polishing pad, the polishing pad 300 of the invention may retain the polishing fluid, and therefore for some actual polishing processes, the polishing pad 300 of the invention may achieve a higher polishing rate to increase productivity, or the used amount of the polishing fluid may be reduced to save cost.

It may be known from the embodiments of FIG. 1 and FIG. 2 that, in the present embodiment, the groove 304 may have an inclined depth, wherein the depth of the groove 304 is gradually increased from the closed end 304*b* to the open end 304*a*. However, the invention is not limited thereto. In other embodiments, the groove 304 may also not have an inclined depth and have the same depth. It should be mentioned that, the depth inclination (i.e., the depth inclination) of the groove 304 may be selected based on the rotation rate of the polishing pad 300. In a general polishing process, the rotation rate of the polishing pad 300 during the polishing step is generally greater than the rotation rate of the polishing pad 300 during other steps, and therefore a greater inertial force is generated. Thereby, the driving force of the polishing fluid flowing from the front end toward the rear end is greater such that the probability of the polishing fluid flowing out of the open front end is reduced, and the feature that the polishing fluid is retained on the polishing pad 300 may be kept. During the cleaning step after the polishing step, such as cleaning the surface of the polishing pad 300 with water, the rotation rate of the polishing pad 300 is less than the rotation rate of the polishing pad 300 during the polishing step, or the rotation of the polishing 300 during the cleaning step is stopped, and therefore a less inertial force is generated or inertial force is absent. At this point, in comparison to the case in which each groove has the same depth, the polishing pad 300 may enhance the cleaning efficiency via the groove 304 having an inclined depth to reduce the used amount of water for cleaning. As a result, in addition to retaining the polishing fluid on the polishing pad 300, the cleaning efficiency may also be enhanced.

In the present embodiment, the polishing pad 300 may optionally include at least one groove 306 disposed in the polishing layer 302, and the at least one groove 306, for instance, may comprise a plurality of grooves 306 (shown in FIG. 4) disposed in the polishing surface PS of the polishing layer 302. Specifically, each of the grooves 306 may be an annular groove arranged in a concentric manner with the center Z as the central point. In other words, in the present embodiment, the groove 304 and the groove 306 have the same center Z, but the invention is not limited thereto.

Moreover, as shown in FIG. 4, the polishing pad 300 includes a virtual extending straight line V, the virtual extending straight line V passes through the center of the polishing pad 300 and is perpendicular to the tangential direction of the groove 304, and the groove 304 is not symmetric with respect to the virtual extending straight line V. In the present embodiment, since the groove 304 is circular arc and the center Z thereof is not overlapped with the center of the polishing pad 300 (i.e., the rotational axis C) and there is a horizontal displacement between the two centers, the extending direction of the virtual extending straight line V passing through the center of the polishing pad 300 and perpendicular to the tangential direction of the groove 304 is the horizontal direction laterally passing through the diameter of the polishing pad 300. Specifically, the configurations of the two sides of the groove 304 respective to the virtual extending straight line V are asymmetric, in other words, the configurations of the two sides of the groove 304 respective to the virtual extending straight line V are not mirror images of each other, and the reason is that one end of the groove 304 is an open end 304*a* and the other end of the groove 304 is a closed end 304*b*. Moreover, it may be known from the embodiments of FIG. 1 and FIG. 2 that, the depths of the two sides of the groove 304 respective to the virtual extending straight line V may optionally be asymmetric, in other words, the depths of the two sides of the groove 304 respective to the virtual extending straight line V may optionally be not mirror images of each other, and the reason is that the depth of the groove 304 may be gradually increased from the closed end 304*b* to the open end 304*a*. Moreover, the annular groove 306 (shown in FIG. 4) of the polishing pad 300 is symmetric with respect to the virtual extending straight line V, in other words, the configurations of the two sides of the annular groove 306 respective to the virtual extending straight line V are mirror images of each other.

Figure 5:
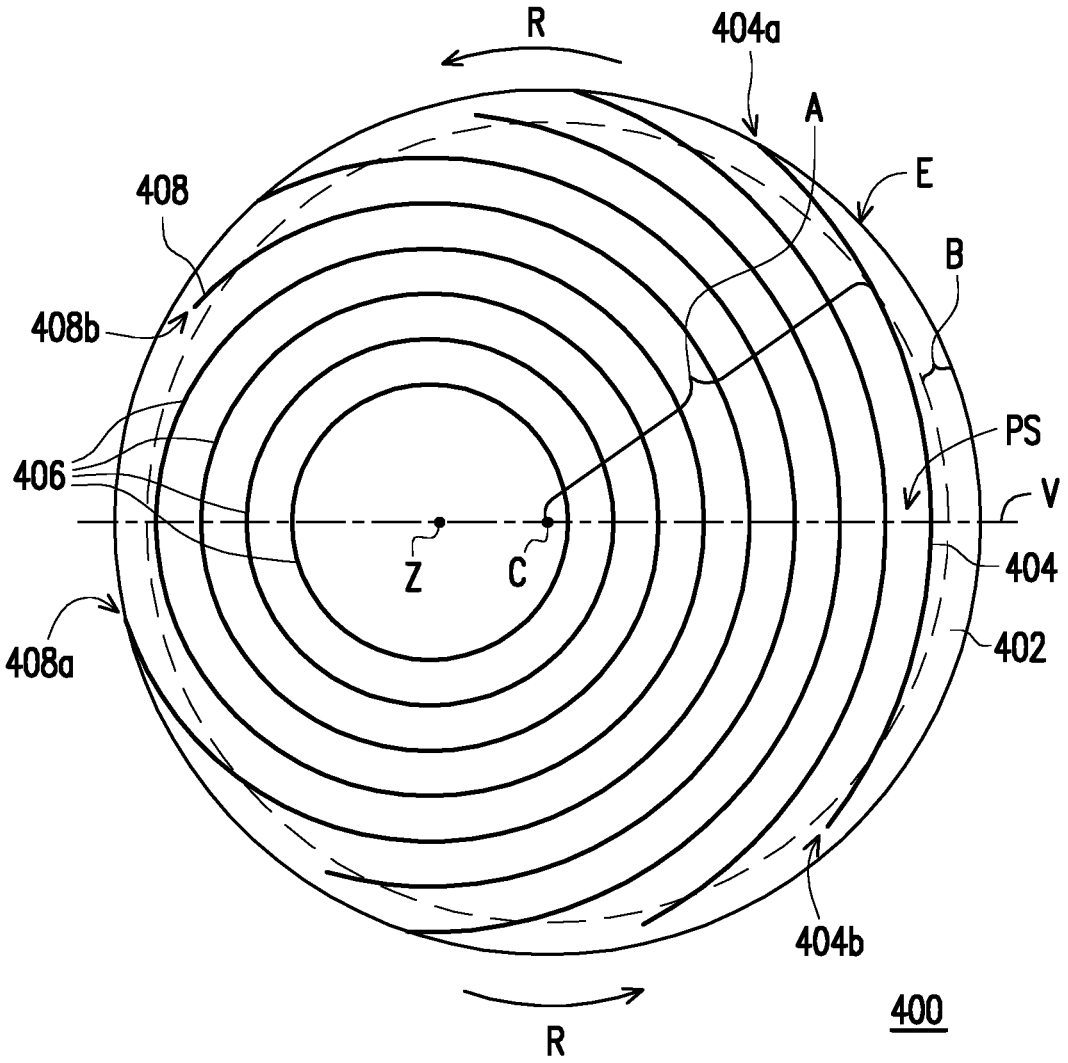
FIG. 5 is a top view of a polishing pad according to another embodiment of the invention.

FIG. 5 is a top view of a polishing pad according to another embodiment of the invention. Referring to both FIG. 5 and FIG. 4, a polishing pad 400 of FIG. 5 is similar to the polishing pad 300 of FIG. 4, and therefore the same or similar elements are represented by the same or similar reference numerals, and relevant descriptions are not repeated. It should be mentioned that, a polishing layer 402, grooves 404, grooves 406, and ends 404*a* and 404*b* may be the same as or similar to their counterparts in the embodiment of FIG. 4 (i.e., the polishing layer 302, the grooves 304, the grooves 306, and the ends 304*a* and 304*b*), and therefore relevant description is not repeated herein. Moreover, the partial perspective schematic of the polishing pad 400 is shown in FIG. 2. In the following, the differences between the polishing pad 400 and the polishing pad 300 are described.

Referring to FIG. 5, the polishing pad 400 includes at least one groove 408 disposed in the polishing layer 402, and the at least one groove 408, for instance, may comprise a plurality of grooves 408 (shown in FIG. 5) disposed in the polishing surface PS of the polishing layer 402. Specifically, the grooves 408 each may have two ends 408*a* and 408*b* both located in the peripheral region B, and the groove 408 may be extended through the central region A. In other words, in the present embodiment, each of the grooves 408 may be extended from the peripheral region B to the central region A and then extended to the peripheral region B after passing through the central region A. In other words, the groove 408 may be extended through the polishing trajectory of the object, and therefore the polishing fluid accommodated in the groove 408 may sufficiently contact with the polished object. Moreover, after the object is polished, the polishing pad 400 may prevent the issue of de-chunk fail of the object (i.e., failure to lift the object away from the polishing surface PS of the polishing pad 400). The width of the peripheral region B (i.e., the width from the edge E in the radius direction) is, for instance, between 5 mm and 80 mm, but the invention is not limited thereto.

It may be known from the embodiments of FIG. 1 and FIG. 2 that, in the present embodiment, the groove 408 has two ends 408*a* and 408*b* both located in the peripheral region B, wherein the end 408*a* is the open end and the end 408*b* is the closed end. The open end 408*a* is connected to the side surface SS of the polishing layer 402 and does not have any end surface, and the closed end 408*b* is not connected to the side surface SS of the polishing layer 402 and has one end surface X. In other words, the open end 408*a* is located at the edge E of the polishing layer 402, and the closed end 408*b* is located within the polishing layer 402 having a spacing between the closed end 408*b* and the edge E, and the spacing is, for instance, between 1 mm and 70 mm, but the invention is not limited thereto. Moreover, it may be known from the embodiments of FIG. 1 and FIG. 2 that, in an embodiment, the end surface X of the closed end 408*b* may be a vertical surface, and the end surface X is perpendicular to the polishing surface PS and connected to the bottom surface of the groove 408 with a transition (i.e., a turn) therebetween. In another embodiment, the end surface X of the closed end 408*b* may be an inclined surface and connected to the bottom surface of the groove 408 with a transition therebetween. In yet another embodiment, the end surface X of the closed end 408*b* may also be an inclined surface without a transition between the inclined surface and the bottom surface of the groove 408. In other words, the depth of the groove 408 is gradually decreased form the open end 408*a* toward the closed end 408*b* and a spacing exists between the closed end 408*b* and the edge E.

In the present embodiment, each of the grooves 408 is a circular arc groove. Specifically, in the present embodiment, the grooves 404 and the grooves 408 have the same center Z, but the invention is not limited thereto. More specifically, in the present embodiment, the plurality of grooves 408 are concentric circular arc grooves having different radii.

In the present embodiment, the rotational direction R of the polishing pad 400 is exemplified by a counterclockwise direction, and therefore in correspondence to the relative motion direction of the polishing pad 400, the open end 408*a* is the rear end and the closed end 408*b* is the front end. That is, in the present embodiment, in correspondence to the relative motion direction of the polishing pad 400, the open end 404*a* and the closed end 408*b* are front ends; and the closed end 404*b* and the open end 408*a* are rear ends. In other words, in the polishing pad 400, the grooves 404 and 408 are divided into two types, wherein the first type is the groove 404 in which the open end 404*a* is the front end and the closed end 404*b* is the rear end, and the second type is the groove 408 in which the closed end 408*b* is the front end and the open end 408*a* is the rear end. Specifically, since the groove 404 is located at the right side of the rotational axis C, the open end 404*a* (i.e., front end) is located above the rotational axis C, and the closed end 404*b* (i.e., rear end) is located below the rotational axis C. Moreover, since the groove 408 is located at the right side of the rotational axis C, the open end 408*a* (i.e., rear end) is located below the axis rotation C, and the closed end 408*b* (i.e., front end) is located above the rotational axis C.

In the present embodiment, the grooves 408 are all disposed adjacent to the grooves 404. Specifically, two grooves 408 are spaced apart by the groove 404 (shown in FIG. 5). However, the invention is not limited thereto, two grooves 408 may also be adjacent to each other. In the grooves each having two ends of the present embodiment, the first type is the groove 404 and the second type is the groove 408. This configuration is covered by the scope of the present embodiment and is not limited to a specific arrangement.

For some specific polishing processes, less amount of byproduct is generated by the polishing, and therefore these polishing processes need to be able to discharge the byproduct to prevent contamination or defects to the object. In a conventional polishing pad having a similar groove pattern distribution used in the industry, the two ends of each groove are both open ends. Driven by the inertial force, the byproduct generated by the polishing readily flow out of the conventional polishing pad from the rear end. However, the polishing fluid may not be retained on the conventional polishing pad, such that the productivity is affected. In the present embodiment, in correspondence to the relative motion direction of the polishing pad 400, the closed end 408*b* of the groove 408 is the front end and the open end 408*a* of the groove 408 is the rear end, and the closed end 404*b* of the groove 404 is the rear end and the open end 404*a* of the groove 404 is the front end. Therefore, in the case that a polishing procedure is performed on an object using the polishing pad 400, when the byproduct and the polishing fluid driven by an inertial force, in addition to effectively discharging the byproduct generated by the polishing from the rear end (i.e., the open end 408*a*) of the groove 408, the rear end (i.e., the closed end 404*b*) of the groove 404 may block the polishing fluid from flowing out of the polishing pad 400 such that the flow field of the polishing fluid may overflow from the groove 404 to the polishing surface PS to achieve a higher polishing rate, and the byproduct generated by the polishing may flow to the groove 408 to be discharged from the polishing pad 400. Therefore, the utilization efficiency of the polishing fluid may be enhanced. In comparison to the conventional polishing pad, the polishing pad 400 of the invention may retain the polishing fluid and discharge byproduct at the same time, and therefore for some polishing processes that produce less amount of byproduct, the polishing pad 400 of the invention may achieve a higher polishing rate to increase productivity, and contamination or defect to the object by the byproduct may be prevented.

It may be known from the embodiments of FIG. 1 and FIG. 2 that, in the present embodiment, similar to the groove 404, the groove 408 may also have an inclined depth, wherein the depth of the groove 408 is gradually increased from the closed end 408*b* to the open end 408*a*. However, the invention is not limited thereto. In other embodiments, the groove 408 may also not have an inclined depth and have the same depth. It should be mentioned that, since the main function of the groove 408 designed is to discharge byproduct generated by the polishing, the depth inclination (i.e., the depth inclination) of the groove 408 may optionally be greater than the depth inclination (i.e., the inclination of the depth) of the groove 404. Moreover, the depth inclination of the groove 408 may be decided based on the amount of byproduct generated and the rotation rate of the polishing pad 400, wherein when the depth inclination of the groove 408 is greater and the rotation rate of the polishing pad 400 is larger, more byproduct may be discharged. In a general polishing process, during the cleaning step after the polishing step, such as cleaning the surface of the polishing pad 400 with water, the rotation rate of the polishing pad 400 is less than the rotation rate of the polishing pad 400 during the polishing step, or the rotation of the polishing pad 400 during the cleaning step is stopped, and therefore a less inertial force is generated, or inertial force is absent. At this point, in comparison to the case in which the groove has the same depth, the polishing pad 400 may increase the cleaning efficiency via the groove 404 and the groove 408 respectively having an inclined depth to reduce the used amount of water for cleaning.

Moreover, as shown in FIG. 5, the polishing pad 400 includes a virtual extending straight line V, and the virtual extending straight line V passes through the center of the polishing pad 400 and is perpendicular to the tangential directions of the grooves 404 and 408, wherein the grooves 404 and 408 are not symmetric with respect to the virtual extending straight line V. In the present embodiment, since the grooves 404 and 408 are circular arcs and the center Z thereof is not overlapped with the center of the polishing pad 400 (i.e., the rotational axis C) and a horizontal displacement is between the two centers, the extending direction of the virtual extending straight line V passing through the center of the polishing pad 400 and perpendicular to the tangential directions of the grooves 404 and 408 is the horizontal direction laterally passing through the diameter of the polishing pad 400. Specifically, the configurations of the two sides of the groove 404 respective to the virtual extending straight line V are asymmetric, and the configurations of the two sides of the groove 408 respective to the virtual extending straight line V are asymmetric. In other words, the configurations of the two sides of the groove 404 respective to the virtual extending straight line V are not mirror images of each other, and the reason is that one end of the groove 404 is the open end 404*a* and the other end of the groove 404 is the closed end 404*b*; and the configurations of the two sides of the groove 408 respective to the virtual extending straight line V are not mirror images of each other, and the reason is that one end of the groove 408 is the open end 408*a* and the other end of the groove 408 is the closed end 408*b*. Moreover, it may be known from the embodiments of FIG. 1 and FIG. 2 that, the depths of the two sides of the groove 404 respective to the virtual extending straight line V may optionally be asymmetric, and the depths of the two sides of the groove 408 respective to the virtual extending straight line V may optionally be asymmetric. In other words, the depths of the two sides of the groove 404 respective to the virtual extending straight line V may optionally be not mirror images of each other, and the reason is that the depth of the groove 404 may be gradually increased from the closed end 404*b* to the open end 404*a*; and the depths of the two sides of the groove 408 respective to the virtual extending straight line V may optionally be not mirror images of each other, and the reason is that the depth of the groove 408 may be gradually increased from the closed end 408*b* to the open end 408*a*. Moreover, the annular groove 406 (shown in FIG. 5) of the polishing pad 400 is symmetric with respect to the virtual extending straight line V, in other words, the configurations of the two sides of the annular groove 406 respective to the virtual extending straight line V are mirror images of each other.

Moreover, in the embodiment of FIG. 5, although the distribution profile of the grooves 404 and 408 is a concentric arcs shape, the invention is not limited thereto. In other embodiments, the distribution profile of the grooves having two ends of the polishing pad may also be a parallel lines shape, a non-parallel lines shape, an XY grid lines shape, a cross-hatched lines shape, an eccentric arcs shape, an irregular arcs shape, a combination thereof, or a combination of a concentric arcs shape and the various distribution profiles above, wherein the grooves are divided into a first type and a second type, and in the groove of the first type, the open end is the front end and the closed end is the rear end; and in the groove of the second type, the closed end is the front end and the open end is the rear end.

Figure 6:
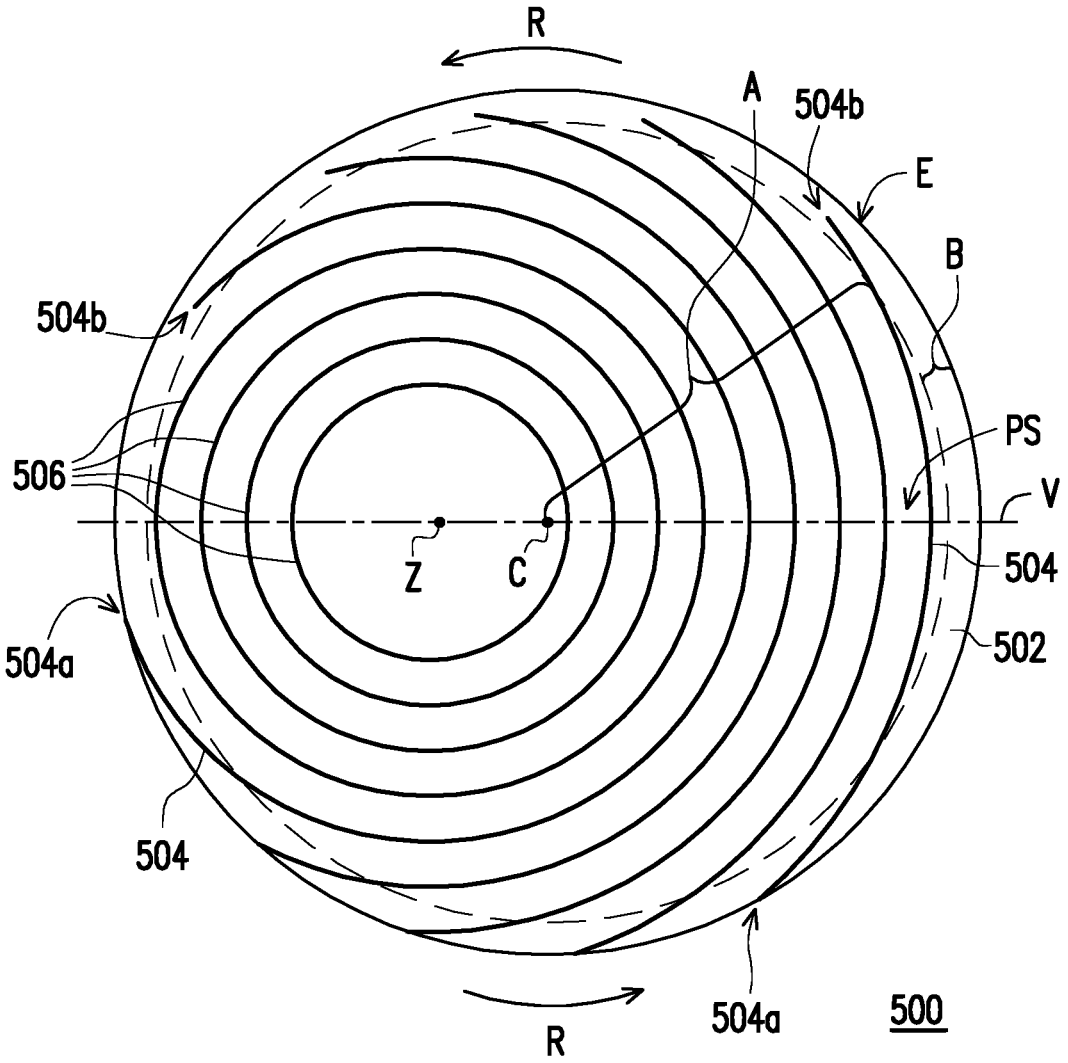
FIG. 6 is a top view of a polishing pad according to another embodiment of the invention.

FIG. 6 is a top view of a polishing pad according to another embodiment of the invention. Referring to both FIG. 6 and FIG. 4, a polishing pad 500 of FIG. 6 is similar to the polishing pad 300 of FIG. 4, and therefore the same or similar elements are represented by the same or similar reference numerals, and relevant descriptions are not repeated. It should be mentioned that, a polishing layer 502 and grooves 506 may be the same as or similar to their counterparts in the embodiment of FIG. 4 (i.e., the polishing layer 302 and the grooves 306), and therefore relevant description is not repeated herein. Moreover, the partial perspective schematic of the polishing pad 500 is shown in FIG. 2. In the following, the differences between the polishing pad 500 and the polishing pad 300 are described.

Referring to FIG. 6, the polishing pad 500 includes at least one groove 504 disposed in the polishing layer 502, and the at least one groove 504, for instance, may comprise a plurality of grooves 504 (shown in FIG. 6) disposed in the polishing surface PS of the polishing layer 502. Specifically, the grooves 504 each may have two ends 504*a* and 504*b* both located in the peripheral region B, and the groove 504 may be extended through the central region A. In other words, in the present embodiment, each of the grooves 504 may be extended from the peripheral region B to the central region A and then extended to the peripheral region B after passing through the central region A. In other words, the groove 504 may be extended through the polishing trajectory of the object, and therefore the polishing fluid accommodated in the groove 504 may sufficiently contact with the polished object. Moreover, after the object is polished, the polishing pad 500 may prevent the issue of de-chunk fail of the object (i.e., failure to lift the object away from the polishing surface PS of the polishing pad 500). The width of the peripheral region B (i.e., the width from the edge E in the radius direction) is, for instance, between 5 mm and 80 mm, but the invention is not limited thereto.

It may be known from the embodiments of FIG. 1 and FIG. 2 that, in the present embodiment, the groove 504 has two ends 504*a* and 504*b* both located in the peripheral region B, wherein the end 504*a* is the open end and the end 504*b* is the closed end. The open end 504*a* is connected to the side surface SS of the polishing layer 502 and does not have any end surface, and the closed end 504*b* is not connected to the side surface SS of the polishing layer 502 and has an end surface X. In other words, the open end 504*a* is located at the edge E of the polishing layer 502, and the closed end 504*b* is located within the polishing layer 502 having a spacing between the closed end 504*b* and the edge E, and the spacing is, for instance, between 1 mm and 70 mm, but the invention is not limited thereto. Moreover, it may be known from the embodiments of FIG. 1 and FIG. 2 that, in an embodiment, the end surface X of the closed end 504*b* may be a vertical surface, and the end surface X is perpendicular to the polishing surface PS and connected to the bottom surface of the groove 504 with a transition (i.e., a turn) therebetween. In another embodiment, the end surface X of the closed end 504*b* may be an inclined surface and connected to the bottom surface of the groove 504 with a transition therebetween. In yet another embodiment, the end surface X of the closed end 504*b* may also be an inclined surface without a transition between the inclined surface and the bottom surface of the groove 504. In other words, the depth of the groove 504 is gradually decreased form the open end 504*a* toward the closed end 504*b* and a spacing exists between the closed end 504*b* and the edge E.

In the present embodiment, each of the grooves 504 is a circular arc groove, and the center Z thereof is not overlapped with the rotational axis C of the polishing pad 500. More specifically, in the present embodiment, the plurality of grooves 504 are concentric circular arc grooves having different radii.

In the present embodiment, the rotational direction R of the polishing pad 500 is exemplified by a counterclockwise direction, and therefore in correspondence to the relative motion direction of the polishing pad 500, the open end 504*a* is the rear end and the closed end 504*b* is the front end. Specifically, since the groove 504 is located at the right side of the rotational axis C, the open end 504*a* (i.e., rear end) is located below the axis rotation C, and the closed end 504*b* (i.e., front end) is located above the rotational axis C.

For some specific polishing processes, since more byproduct is generated by the polishing, the byproduct needs to be effectively discharged to prevent contamination or defect to the object. In industrial polishing equipment, a splash guard (i.e., a shielding cover to prevent splashing) encircling the platen is generally equipped to prevent the polishing fluid or byproduct from splashing to the surrounding area. However, since more byproduct is generated during the polishing process, the byproduct accumulated on the splash guard may be adhered to the side surface of the polishing pad due to a splash-back effect. In the present embodiment, in correspondence to the relative motion direction of the polishing pad 500, the closed end 504*b* is the front end and the open end 504*a* is the rear end. Therefore, in the case that a polishing process is performed on an object using the polishing pad 500, driven by the inertial force, the byproduct generated by the polishing may be effectively discharged from the rear end (i.e., the open end 504*a*).

From a different perspective, in a conventional polishing pad having a similar groove pattern distribution, the two ends of each groove are both open ends, and some of the byproduct splashed back on the side surface of the conventional polishing pad may return on the conventional polishing pad via the open end, driven by an inertial force, thus resulting in contamination or defect to the object. In comparison, in the present embodiment, in correspondence to the relative motion direction of the polishing pad 500, since the front end of the groove 504 is the closed end 504*b*, some of the byproduct splashed back on the side surface SS may be prevented from returning on the polishing pad 500. Therefore, in comparison to the conventional polishing pad, for some polishing processes generating more byproduct during polishing, the polishing pad 500 of the invention may effectively discharge byproduct generated by the polishing to prevent contamination or defect to the object.

It may be known from the embodiments of FIG. 1 and FIG. 2 that, in the present embodiment, the groove 504 may have an inclined depth, wherein the depth of the groove 504 is gradually increased from the closed end 504*b* to the open end 504*a*. However, the invention is not limited thereto. In other embodiments, the groove 504 may also not have an inclined depth and have the same depth. It should be mentioned that, since the main function of the grooves 504 design is to discharge byproduct generated by the polishing, the depth inclination (i.e., the inclination of the depth) of the groove 504 may be decided based on the amount of the byproduct generated and the rotation rate of the polishing pad 500, wherein when the depth inclination of the groove 504 is great and the rotation rate of the polishing pad 500 is great, more byproduct may be discharged. In a general polishing process, during the cleaning step after the polishing step, such as cleaning the surface of the polishing pad 500 with water, the rotation rate of the polishing pad 500 is less than the rotation rate of the polishing pad 500 during the polishing step, or the rotation of the polishing pad 500 during the cleaning step is stopped, and therefore a less inertial force is generated, or inertial force is absent. At this point, in comparison to the case in which each groove has the same depth, the polishing pad 500 may enhance the cleaning efficiency via the groove 504 having an inclined depth to reduce the used amount of water for cleaning.

Moreover, as shown in FIG. 6, the polishing pad 500 includes a virtual extending straight line V, the virtual extending straight line V passes through the center of the polishing pad 500 and is perpendicular to the tangential direction of the groove 504, and the groove 504 is not symmetric with respect to the virtual extending straight line V. In the present embodiment, since the grooves 504 are circular arcs and the center Z thereof is not overlapped with the center of the polishing pad 500 (i.e., the rotational axis C) and a horizontal displacement is between the two centers, the extending direction of the virtual extending straight line V passing through the center of the polishing pad 500 and perpendicular to the tangential direction of the grooves 504 is the horizontal direction laterally passing through the diameter of the polishing pad 500. Specifically, the configurations of the two sides of the groove 504 respective to the virtual extending straight line V are asymmetric, in other words, the configurations of the two sides of the groove 504 respective to the virtual extending straight line V are not mirror images of each other, and the reason is that one end of the groove 504 is the open end 504*a* and the other end is of the groove 504 the closed end 504*b*. Moreover, it may be known from the embodiments of FIG. 1 and FIG. 2 that, the depths of the two sides of the groove 504 respective to the virtual extending straight line V may optionally be asymmetric, in other words, the depths of the two sides of the groove 504 respective to the virtual extending straight line V may optionally be not mirror images of each other, and the reason is that the depth of the groove 504 may be gradually increased from the closed end 504*b* to the open end 504*a*. Moreover, the annular groove 506 (shown in FIG. 6) of the polishing pad 500 is symmetric with respect to the virtual extending straight line V, in other words, the configurations of the two sides of the annular groove 506 respective to the virtual extending straight line V are mirror images of each other.

Moreover, in the embodiment of FIG. 6, although the distribution profile of the grooves 504 is a concentric arcs shape, the invention is not limited thereto. In other embodiments, the distribution profile of the grooves having two ends of the polishing pad may also be a parallel lines shape, a non-parallel lines shape, an XY grid lines shape, a cross-hatched lines shape, an eccentric arcs shape, an irregular arcs shape, a combination thereof, or a combination of a concentric arcs shape and the various distribution profiles above, wherein the closed end of the groove is the front end and the open end of the groove is the rear end.

In each of the embodiments above, the relative motion direction of the polishing pad is exemplified by a counter-clockwise rotating direction, but the invention is not limited thereto. In another embodiment, based on designs of different polishing equipment, the relative motion direction of the polishing pad may also be a clockwise rotating direction, and the front end of the groove shown in each embodiment above changes into the rear end, and the rear end of the groove shown in each embodiment above changes into the front end. Moreover, in other embodiments, the relative motion direction of the polishing pad may also be an orbital trajectory motion direction, a linear motion direction, or other motion directions, and the locations of the front end and the rear end of the groove also have different distribution locations as a result. Moreover, the grooves in each embodiment above are shown in equidistance, but the scope of the invention is not limited thereto, and the grooves may also optionally be not completely equidistant. Moreover, the polishing processes in the embodiments above are only examples of possible industrial applications and are not intended to limit the scope of the invention. The polishing pads designed in the embodiments above may also be optionally applied in other polishing processes.

Figure 7:
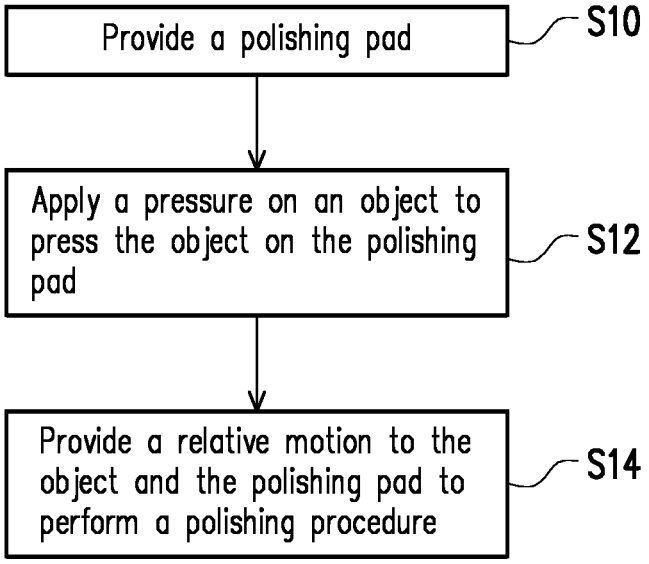
FIG. 7 is a flowchart of a polishing method according to an embodiment of the invention.

FIG. 7 is a flowchart of a polishing method according to an embodiment of the invention. The polishing method is suitable for polishing an object. Specifically, the polishing method may be applied to polishing processes for manufacturing industrial devices, such as applications in devices in the electronics industry, including semiconductors, integrated circuits, micro electro-mechanics, energy conversion, communication, optics, storage disks, and displays. The objects used for manufacturing the devices may include, for instance, semiconductor wafers, Group III-V wafers, storage device carriers, ceramic substrates, polymer substrates, and glass substrates, but the scope of the invention is not limited thereto.

Referring to FIG. 7, first, in step S10, a polishing pad is provided. Specifically, in the present embodiment, the polishing pad may be any type of polishing pad as described in the foregoing embodiments, such as the polishing pad 100, 200, 300, 400, or 500. Relevant descriptions of the polishing pads 100, 200, 300, 400, and 500 are provided in detail in the above and are therefore not repeated herein.

Next, in step S12, a pressure is applied to an object. Thereby, the object is pressed on the polishing pad and in contact with the polishing pad. Specifically, as described above, the object is in contact with the polishing surface PS of the polishing layer 102, 202, 302, 402, or 502. Moreover, the method of applying the pressure to the object is performed by using a carrier that can hold the object, for example.

Afterwards, in step S14, a relative motion is applied between the object and the polishing pad to perform a polishing procedure on the object using the polishing pad to achieve the purpose of planarization. Specifically, the method of providing relative motion to the object and the polishing pad includes, for instance, rotating the polishing pad fixed on a platen along the rotational direction R by rotating the platen.

Although the invention has been described with reference to the above embodiments, it will be apparent to one of ordinary skill in the art that modifications to the described embodiments may be made without departing from the spirit of the invention. Accordingly, the scope of the invention is defined by the attached claims not by the above detailed descriptions.

What is claimed is:

1. A polishing pad suitable for polishing an object, the polishing pad comprising:

a polishing layer, having a central region and a peripheral region surrounding the central region; and at least one groove disposed in the polishing layer, wherein the at least one groove has two ends both located in the peripheral region, and the two ends comprise an open end and a closed end, and wherein the at least one groove is extended through the central region.

2. The polishing pad of claim 1, wherein the polishing layer has a polishing surface and a side surface connected to the polishing surface, the open end is connected to the side surface of the polishing layer, and the closed end is not connected to the side surface of the polishing layer and has an end surface.

3. The polishing pad of claim 2, wherein the end surface is a vertical surface or an inclined surface.

4. The polishing pad of claim 1, wherein a polishing trajectory of the object on the polishing layer is located in the central region.

5. The polishing pad of claim 1, wherein a depth of the at least one groove is gradually increased from the closed end to the open end.

6. The polishing pad of claim 1, wherein in correspondence to a relative motion direction of the polishing pad, the open end is the front end and the closed end is the rear end.

7. The polishing pad of claim 1, wherein in correspondence to a relative motion direction of the polishing pad, the closed end is the front end and the open end is the rear end.

8. The polishing pad of claim 1, wherein the at least one groove comprises a plurality of grooves, and the plurality of grooves are divided into a first ype and a second type, wherein in correspondence to a relative motion direction of the polishing pad:

the open end of the first type is the front end and the closed end of the first type is the rear end; and the closed end of the second type is the front end and the open end of the second type is the rear end.

9. The polishing pad of claim 8, wherein a depth of the first type is gradually increased from the closed end to the open end and has a first depth inclination, and a depth of the second type is gradually increased from the closed end to the open end and has a second depth inclination, wherein the second depth inclination is greater than the first depth inclination.

10. The polishing pad of claim 1, wherein the at least one groove is a linear groove or an arc groove.

11. The polishing pad of claim 1, wherein the at least one groove is a circular arc groove, the polishing pad has a rotational axis, and a center of the circular arc groove is not overlapped with the rotational axis.

12. The polishing pad of claim 1, wherein a distribution profile of the at least one groove is a parallel lines shape, a non-parallel lines shape, an XY grid lines shape, a cross-hatched lines shape, a concentric arcs shape, an eccentric arcs shape, an irregular arcs shape, or a combination thereof.

13. A polishing method, comprising:

providing a polishing pad, wherein the polishing pad is the polishing pad of claim 1;

applying a pressure to the object to press the object on the polishing pad; and applying a relative motion between the object and the polishing pad to perform a polishing procedure.

* * * * *